United States Patent [19]

Stroh

[11] Patent Number: 4,512,540

[45] Date of Patent: Apr. 23, 1985

[54] PLASTIC BAG RACK FOR CHECKSTAND

[75] Inventor: Alvin L. Stroh, Downey, Calif.

[73] Assignee: McMillin Wire and Plating, Inc., Los Angeles, Calif.

[21] Appl. No.: 486,262

[22] Filed: Apr. 18, 1983

[51] Int. Cl.[3] ..... B65B 67/12

[52] U.S. Cl. ..... 248/95; 53/390; 248/99

[58] Field of Search ..... 248/95, 97, 99, 100, 248/101; 150/51, 49; 53/384, 390; 141/390, 391

[56] References Cited

U.S. PATENT DOCUMENTS

| | | | |
|---|---|---|---|
| 2,100,235 | 11/1937 | Brown | 248/100 X |
| 2,235,182 | 3/1941 | Weston | 248/100 |
| 2,401,969 | 6/1946 | Schlank | 248/100 X |
| 3,480,114 | 11/1969 | Shoffner | 53/390 X |
| 3,557,907 | 1/1971 | Close | 53/390 UX |
| 3,841,592 | 10/1974 | Witten | 248/97 X |
| 4,199,122 | 4/1980 | Christie | 248/97 |
| 4,223,858 | 9/1980 | Salazar | 248/101 |
| 4,304,379 | 12/1981 | Christensen | 248/101 |
| 4,305,558 | 12/1981 | Baker | 53/390 X |
| 4,332,361 | 6/1982 | McClellan | 248/95 |

*Primary Examiner*—J. Franklin Foss

*Attorney, Agent, or Firm*—John T. Matlago

[57] ABSTRACT

A rack for a plastic bag has its back adjustably mounted by a pair of attachment devices on the undersurface of a hinged panel which normally covers a well provided on the table top of a checkstand in a supermarket. When a checkout clerk at the checkstand starts to work without a bagboy assisting her, she swings the panel into a upright position and lowers it into a guideway provided on the rear of the well, and then moves the rack to an elevated position on the pair of attachment devices. This enables the handles of a plastic bag to be placed over the side support arms of the rack so as to suspend the bag in an open position in the well to facilitate the clerk placing items therein as they are rung up on the register.

10 Claims, 9 Drawing Figures

PLASTIC BAG RACK FOR CHECKSTAND

BACKGROUND OF THE INVENTION

This invention relates to bag racks and more particularly to an adjustably mounted rack for use in suspending a plastic bag in an open position on a checkstand in a supermarket.

Many checkstands in a supermarket provide a hinged panel which forms a part of the table top and is positioned over a well located immediately in front of where the clerk stands. When the clerk is working at the checkstand without the assistance of a bagboy for placing the items purchased in a bag, she swings the panel upwardly on its hinges and lowers it into a guideway provided on the rear of the well. This leaves the well open so that the clerk can place an opened paper bag on the bottom surface thereof into which she can put the purchased items as they are rung up. Then, when the clerk again gets busy and has a bagboy to assist her, she lifts the panel out of the guideway and swings it downwardly on its hinges to cover the well so that she can more conveniently slide the items, as they are rung up, onto the end table of the checkstand where the bagboy can provide for placing them in a paper bag.

With the advent of the use of plastic bags for holding items purchased at a supermarket, because of the thin pliable material of which the bags are made, there is a need to provide a rack in the well of the checkstand that can be used by the clerk to suspend the bag in an open position when she starts to work without a bagboy.

SUMMARY OF THE INVENTION

In accordance with the present invention, a rack for use in supporting a plastic bag comprises a framework of rod material formed to include a pair of side support arms having front and rear shoulders. The ends of the rear shoulders are joined by an upper transverse member and each of the front shoulders is provided with a downwardly and rearwardly extending bottom side, the ends of which are joined by a lower transverse member. A pair of strip members is connected across the upper and lower transverse members forming the back of the rack.

A hinged panel which normally is positioned over a well provided on the table top of a checkstand in a supermarket is provided with a pair of attachment devices on the undersurface thereof. Each attachment device has a longitudinal slot on the front wall thereof and includes a pair of pins having heads on one end thereof which hold the pins so that they are slideably engaged in the longitudinal slot. The opposite ends of the pair of pins are engaged to one of the strip members connected on the back of the rack. Thus, when the panel is positioned to cover the well provided on the table top of the checkstand, the pairs of pins are slideably moved to the rear ends of the longitudinal slots on the respective attachment devices such that the rack depends from the undersurface of the panel so as to reside within the confines of the well. Then, when the panel is moved to an upright position in a guideway provided on the rear of the well, the pairs of pins are slideably moved to the upper ends of the longitudinal slots on the front walls of the respective attachment devices and latched in place. This locates the rack at such a height on the checkstand that when a plastic bag is fitted with its side handles over the side support arms thereof, the bag is suspended with the bottom thereof just contacting the bottom surface of the well.

Accordingly, an object of the present invention is to provide for permanently mounting a plastic bag rack on a checkstand at a supermarket such that it can be stored in an out of the way location thereon when not needed and can be readily made available for use by a checkout clerk when she does not have a bagboy assisting her.

Another object of the present invention is to provide for adjustable mounting a plastic bag rack on a hinged panel such that when the panel is covering a well provided on the table top of the checkstand the rack can be stored in the well underneath the panel and when the panel is swung into a vertical position on the rear of the well the rack can be cantilevered from the panel in an elevated operable position relative to the bottom of the well.

With these and other objects in view, the invention consists of the construction, arrangement and combination of the various parts of the device, whereby the objects contemplated are attained, as hereinafter set forth, pointed out in the appended claims and illustrated in the accompanying drawings.

DETAILED DESCRIPTION OF THE INVENTION

Figure 1:
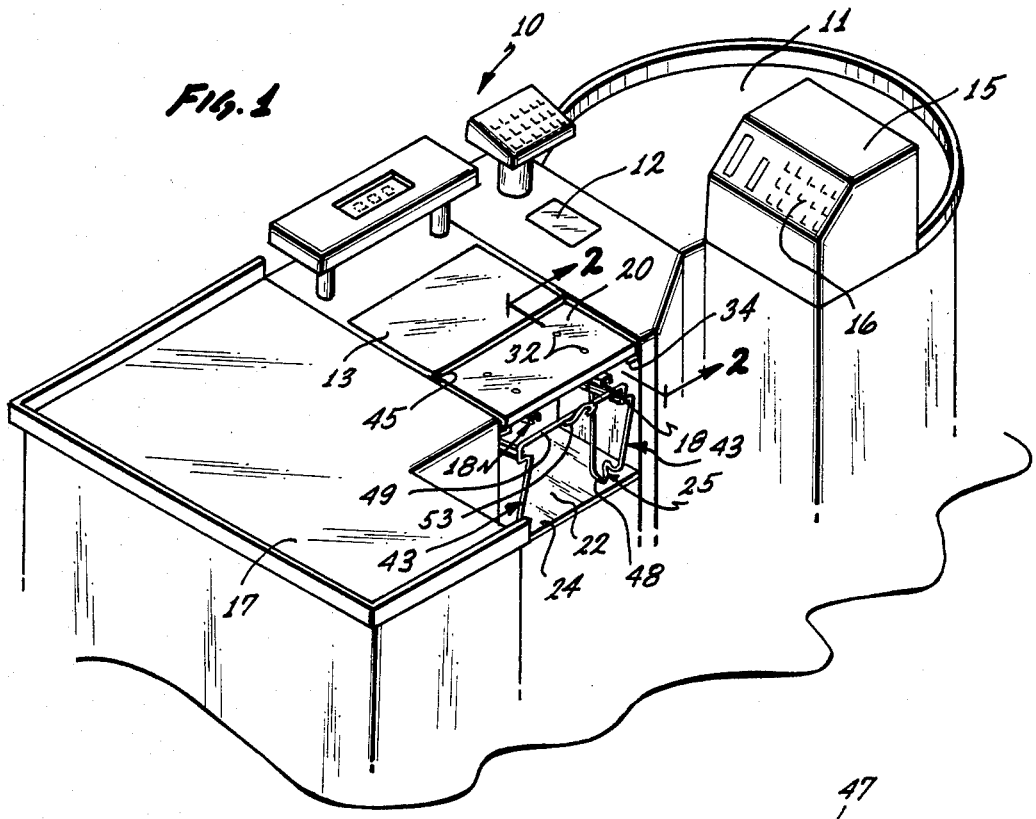
FIG. 1 is a perspective view of a checkstand at a supermarket showing the plastic bag rack of the present invention mounted on the undersurface of a hinged panel covering a well provided on the table top thereof.

Referring to the drawings, FIG. 1 illustrates a typical checkstand 10 as provided at a supermarket. The checkstand 10 includes a turntable 11, a scanner 12, a scale 13, an electronic cash register 15, and an end table 17.

A panel 20 lying flush with the table top is located above a well 22 provided just in front of the scale 13. The checkout clerk stands in front of the well 22. When the clerk has a bagboy assisting her, she takes each item off the turntable 11 and either passes it past the scanner 12 which automatically registers the sale of the item in the cash register, or, if the item has to be weighed or the cost thereof otherwise determined, the clerk rings up the sale hereself using the keyboard 16 on the cash register 15, for example. The items are, in any event, passed over to the end table 17 where the bagboy provides for placing them into a bag (not shown).

However, if the clerk does not have a bagboy assisting her, as during the slower business hours, she has to place each of the purchased items in the bag herself as they are rung up in the register 15. When plastic bags are being used by the clerk she must have a rack to support the bag in an upright position. Thus, in accordance with the present invention, as illustrated in FIG. 1, a plastic bag rack 25 is adjustably mounted by a pair of attachment devices 18 beneath the panel 20 so as to reside in the well 22.

Figure 5:
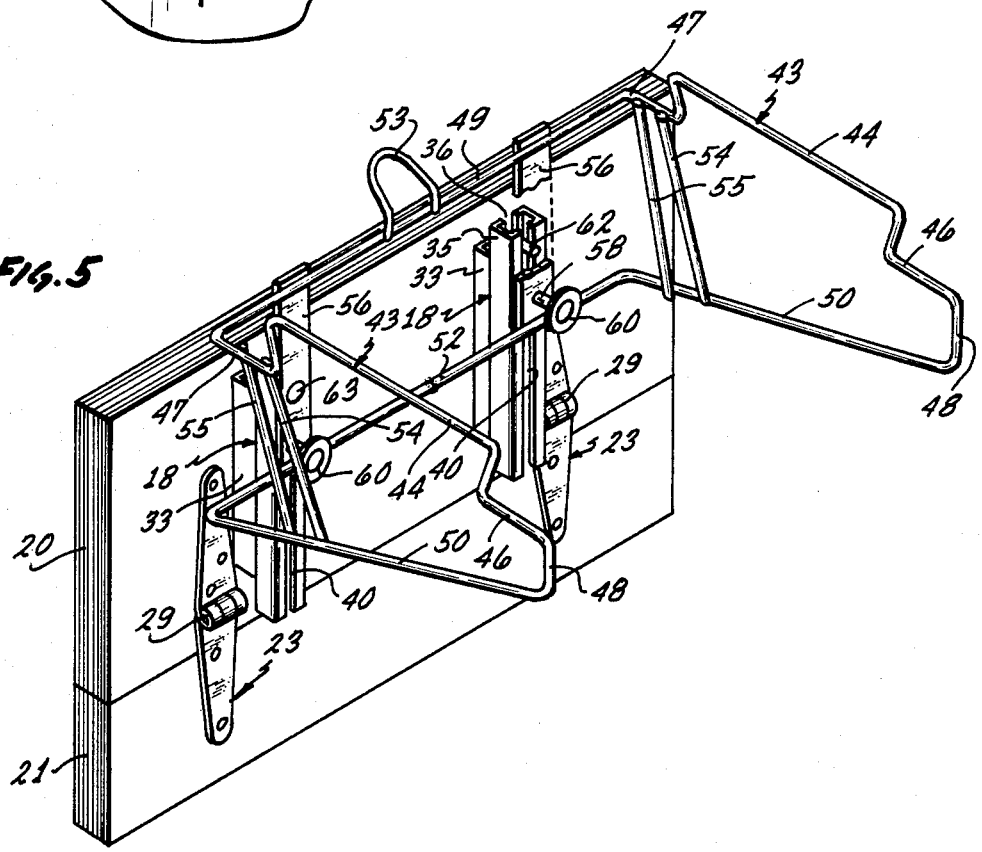
FIG. 5 is a perspective view showing the bag rack in its elevated operable position on the upright panel.
Figure 2:
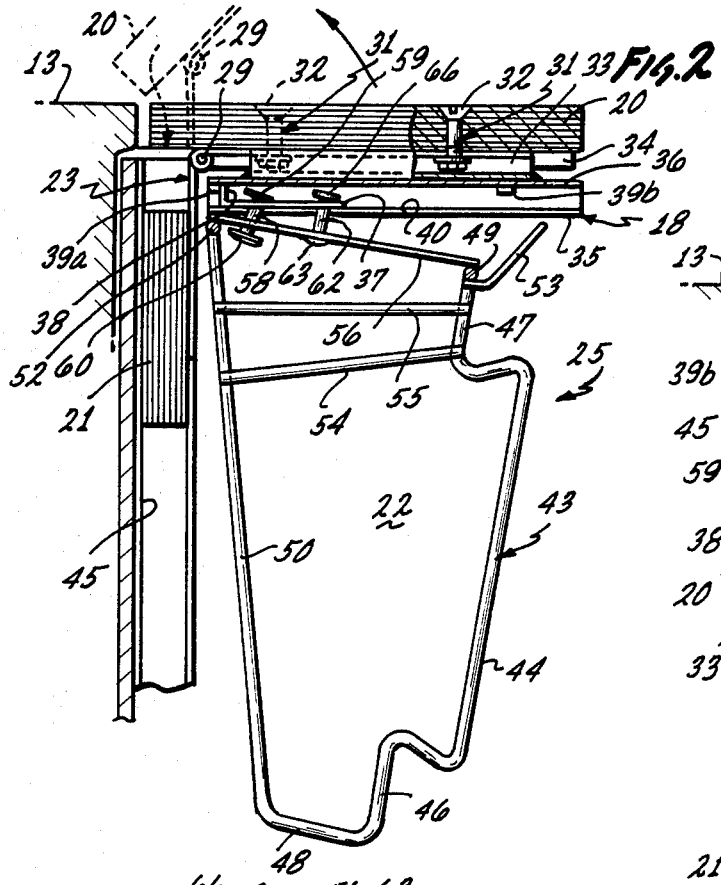
FIG. 2 is a vertical partly sectional view of the plastic bag rack and one of the attachment devices therefor as taken on line 2—2 of FIG. 1.

Reference will next be made to FIG. 2 which shows a vertical partly sectional view of the panel 20 with the rack 25 mounted on the bottom surface thereof, as taken on line 2—2 of FIG. 1. The undersides of the panel 20 rest on ledges 34 provided on the upper sides of the well 22 and the rear of the panel 20 is connected to a retaining member 21 by a pair of hinges 23 (FIG. 5) having joints 29. The retaining members 21 resides in a vertical guideway 45 provided on the rear of the well 22.

One of the attachment devices 18 is mounted on either side of the bottom of the panel 20. Each attachment device 18 includes an inner C-shaped channel member 33 connected to the panel 20 by a pair of nuts and bolts 31. The flat heads 32 of the bolts 31 are positioned flush with the top of the panel 20. An outer C-shaped channel member 35 is positioned back to back on the inner C-shaped channel member 33 and welded thereto. Positioned to slide within the outer C-shaped channel member 33 is a plate member 37 having a bent rear end 38. Buttons **39*a* and 39*b* are provided on the rear and front ends, respectively, of the back inner surface of the outer C-shaped channel member 35. The buttons 39*a* and 39*b* prevent the bent end 38 of plate member 37 from moving therepast and thereby limit the sliding movement of plate member 37 within the outer C-shaped channel member 35**.

The rack 25, which comprises a framework that is preferably formed by bending a single length of steel rod, includes a pair of side support arms 43 each comprising a straight portion 44 with bent ends forming a front shoulder 46 and a rear shoulder 47. The ends of the rear shoulders 47 of the side support arms 43 are joined by an upper transverse member 49 (FIG. 5) and the end of each of the front shoulders 46 of the side support arms 43 is joined by a short vertical portion 48 to a rearwardly extending bottom side member 50, the rear ends of which are joined by a lower transverse member 52. A pair of bracing members 54 and 55 are welded to connect each rear shoulder 47 and the rear portion of a bottom side member 50.

A pair of strip members 56 is welded across the upper and lower transverse members 49 and 52 forming the back of rack 25. Each of the strip members 56 is aligned with and coupled to an outer C-shaped channel member 35 by a first and second pin 58 and 62. The first pin 58 has a flat head 59 on the inner end thereof which resides within the C-shaped channel member 35 and extends loosely through a hole in the sliding plate member 37, through the longitudinal slot 40 (FIG. 5) in the front wall of the outer C-shaped channel member 35, and then loosely through a hole in the strip member 56. A washer 60 is welded to the outer end of the first pin 58. The second pin 62 has a flat head 66 on the inner end thereof which resides within the C-shaped channel member 35 and extends loosely through a hole in the sliding plate member 37, through the longitudinal slot 40 in the front wall of the outer C-shaped channel member 35, and then through a hole in the strip member 56. The outer end of the second pin 62 is welded, as indicated by 63, to the strip member 56.

It should now be clearly understood that each of the strip members 56 on the back of the rack 25 is coupled by a pair of pins 58 and 62 to the outer C-shaped channel member 35 of one of the pair of attachment devices 18 connected to the undersides of the panel 20.

Thus, as shown in FIG. 2, when the rack 25 is disposed to hang below the panel 20 which is positioned to cover the well 22, the first and second pins 58 and 62 held by their flat heads 59 and 66, respectively, are slid along the longitudinal slots 40 of the outer C-shaped channel members 35 towards the back of the well 22 such that the rack 25 is enclosed therein beneath the panel 20.

Figure 4:
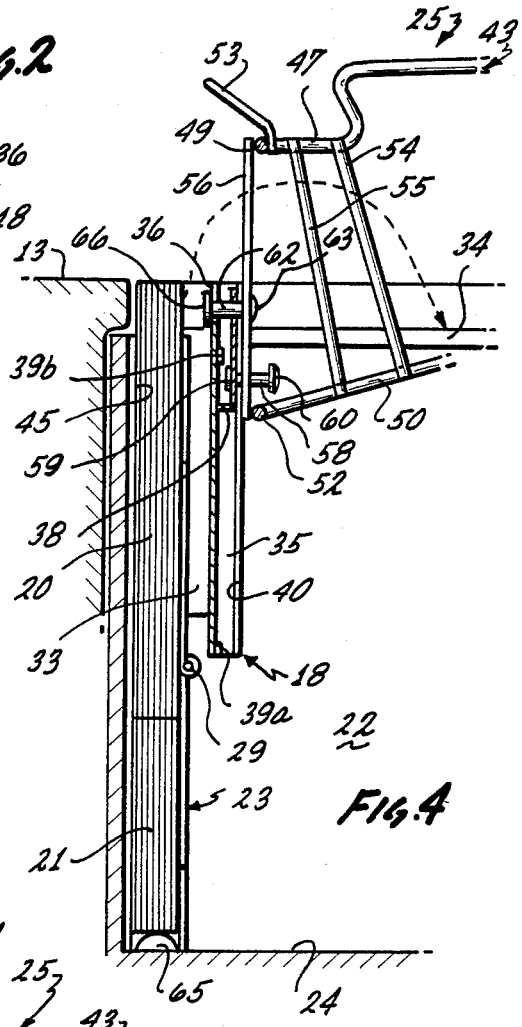
FIG. 4 is a vertical partly sectional view of the plastic bag rack in FIG. 3 after the rack has been shifted upwardly on its attachment devices and latched in its elevated operable position.
Figure 3:
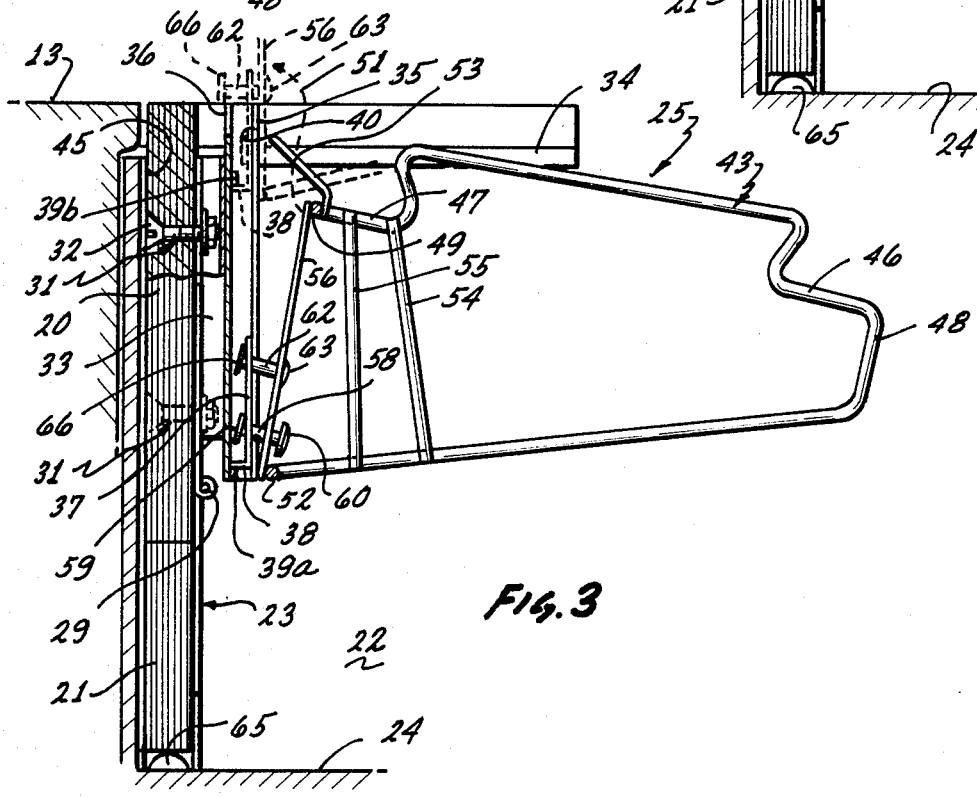
FIG. 3 is a vertical partly sectional view of the plastic bag rack in FIG. 2 after the hinged panel has been swung upwardly and lowered into a guideway provided on the rear of the well with the side support arms of the bag rack cantilevered therefrom.

Now then, when the checkout clerk is required to place the purchased items in a plastic bag herself, she swings the panel 20 upwardly on its hinges 23 and lowers the panel 20 such that it slides in the rear guideway 45 in which the hinged retaining member 21 resides until the bottom of the retaining member 21 rests on rubber stoppers 65 provided on the bottom surface 24 of the well 22, as shown in FIG. 3. The side support arms 43 of the rack 25, which are now each cantilevered from the outer C-shaped channel members 35 by the first and second pins 58 and 62, are lifted upwardly, as indicated by the arrow 51 in FIG. 3, until the sliding plate members 37 are stopped by the upper limiting buttons **39*b* contacting their bent ends 38. At this time, the flat heads 66 of the second pins 62 reside above the upper edges of the outer C-shaped channel members 35. The rack 25 is then pushed inwardly at the top thereof, as indicated by arrow 51, resulting in the second pins 62 whose ends are welded to each of the strip members 56 on the back of the rack 25 to be pushed inwardly such that the flat heads 66 thereof are positioned to reside above the back of the upper slots 36 provided on the back walls of the outer C-shaped channel members 35, as illustrated by phantom lines in FIG. 3. The rack 25 is then lowered causing each of the pins 62 to seat in the upper slots 36 on the back walls of the outer C-shaped channel members 35, as shown in FIG. 4**.

Figure 6:
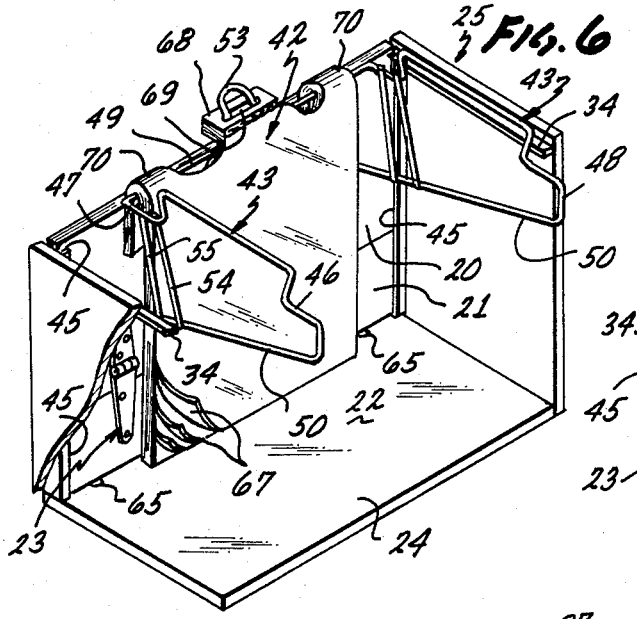
FIG. 6 is a perspective view showing an assembly of plastic bags stored for use on the rack in its elevated operable position on the upright panel.

It should now be understood, as shown in FIG. 6, that an assembly 42 of plastic bags 67 held together by joining tabs 68 on the top center of the back section thereof, can be positioned with the openings 69 on the joining tabs 68 fitted over a hook 53 provided on the middle of the upper transverse member 49 of the rack 25. When the assembly 42 of plastic bags 67 is so held the flat bag handles 70 provided on either side thereof are hung over the sides of the upper transverse member 49 of the rack 25.

It should now be understood that the reason for providing the inner C-shaped channel member 33 on the sides of the bottom surface of the panel 20 is to provide for mounting the rack 25 so that its back is sufficiently spaced away from the scale 13 which is located directly behind the guideway 45 provided on the rear of the well 22 to assure that the bag handles 70 hung thereon do not contact the scale 13 and thereby interfere with its operation.

Figure 7:
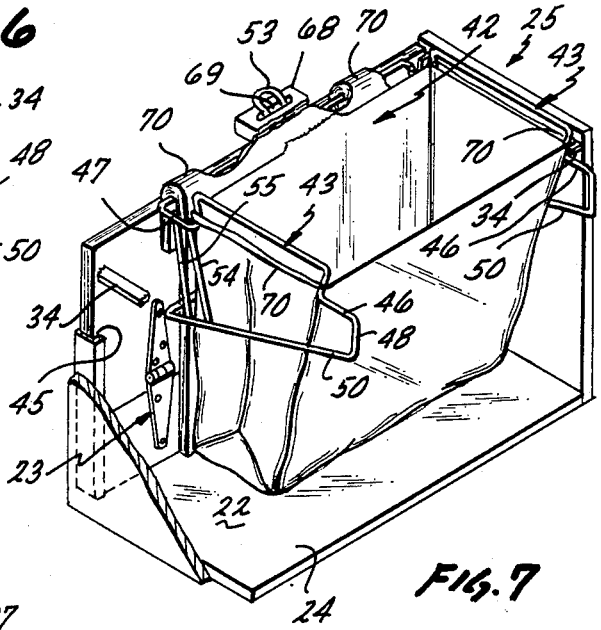
FIG. 7 is a perspective view similar to FIG. 6 showing one of the plastic bags after its tab has been torn off of the assembly of plastic bags and it has been positioned with its handles on the side support arms of the rack.

It should now be evident, as shown in FIG. 7, that a tab 68 of a plastic bag 67 can be torn off the assembly 42 by which it is held and the side handles 70 thereof can be placed over the side support arms 43 of the rack 25 so as to rest on the front and rear shoulders 46 and 47 thereof. Because of the elevated position in which the rack 25 is held on the panel 20, the plastic bag 67 will be suspended such that its bottom just contacts the bottom surface 24 of the well 22.

Figure 8:
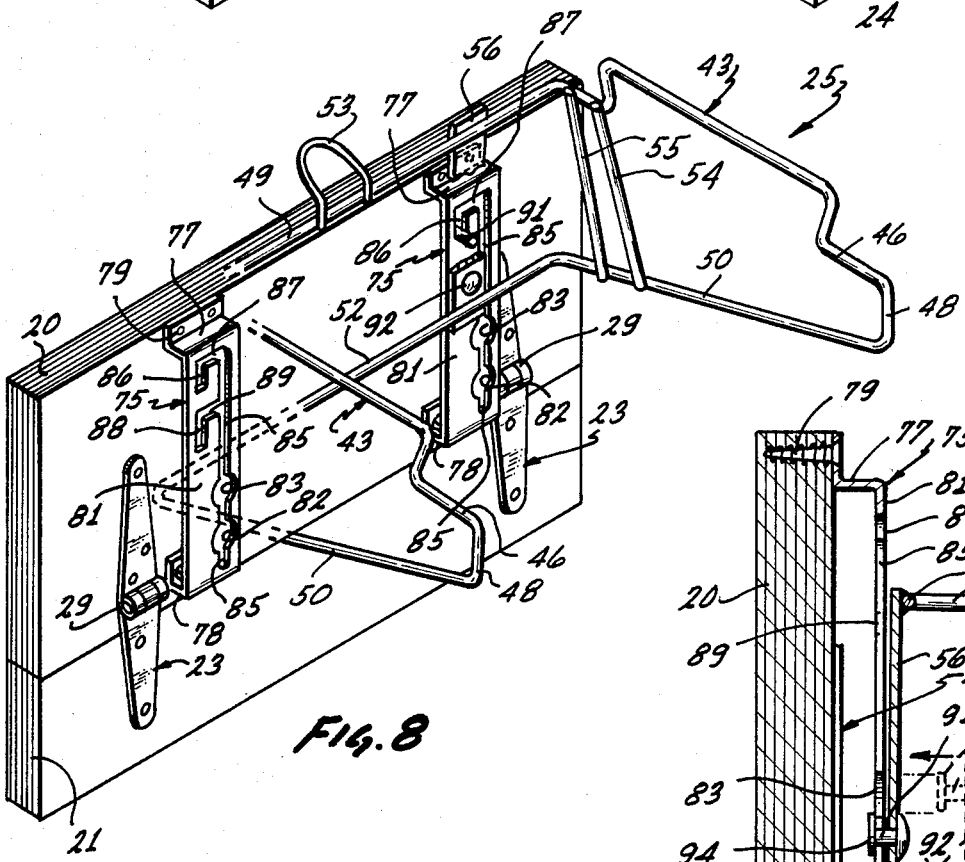
FIG. 8 is a perspective view of an alternate embodiment of the adjustable attachment devices for a plastic bag rack on the panel showing the rack latched in its elevated operable position thereon.

Reference will next be made to FIG. 8 which shows an alternate embodiment of as attachment device of the present invention in the form of a one-piece bracket 75, one of which is attached on each side of the bottom surface of the panel 20, for adjustably mounting the rack 25 so that in one position it is completely enclosed within the well 22 below the horizontally disposed panel 20 and in its other position it is held to extend above the upper edge of the vertically disposed panel 20.

Figure 9:
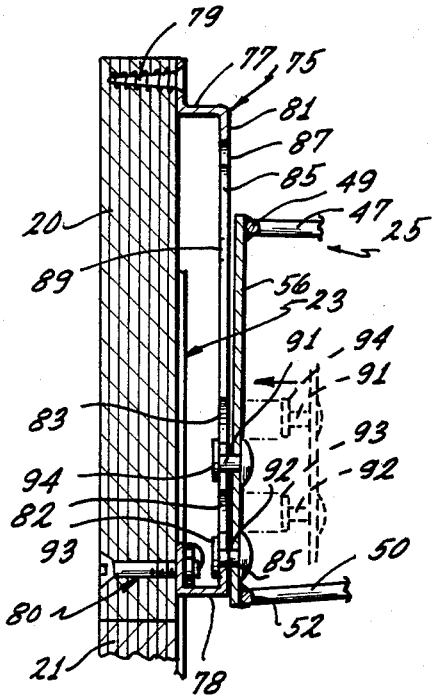
FIG. 9 is a vertical sectional view as taken through one of the attachment devices in FIG. 8 illustrating the rack being held in its lower position thereon.

As shown in FIG. 8, each bracket 75 is formed from a single strip of metal comprising a flat body portion 81 having its outer ends bent at right angles to form end supports 77 and 78 with flat bottoms. As shown in FIG. 9, each bracket 75 is attached to the undersurface of the panel 20 by a screw 79 passing through a hole in the flat bottom of its end support 77 and by a nut and bolt 80 passing through a hole in the inwardly turned flat bottom of its end support 78. The end supports 77 and 78 thus provide for spacing the flat body portions 81 of brackets 75 away from the surface of the panel 20 to assure that the handles 70 of the assembly of bags 67 can be hung over the upper transverse member 49 on the back of rack 25 without contacting the scale 13.

Each of the flat body portions 81 of the brackets 75 is punched by use of a die to provide a pair of spaced circular holes 82 and 83 on the rear or lower portion thereof with a longitudinal slot 85 extending from below the lower circular hole 82 through both circular holes 82 and 83 and continuing on upwardly to the upper end of the flat body portion 81. A pair of transverse slots 87 and 89 is provided on each flat body portion 81. The transverse slot 87 joins to the upper end of the longitudinal slot and the transverse slot 89 joins to the longitudinal slot 85 at a distance spaced from transverse slot 87 the same as the distance between the pair of spaced circular holes 82 and 83. The outer ends of transverse slots 87 and 89 are provided with short terminating downwardly extending slots 86 and 88, respectively, which run parallel to and spaced from the longitudinal slot 85.

The rack, as before, is provided with a pair of strip members 56 welded to extend across the upper and lower transverse members 49 and 52 forming the back of the rack. However, in this case, a pair of spaced pins 91 and 92 have their outer ends passing through holes in the bottom portion of each of the strip members 56 and welded thereto. The inner ends of the pins 92 and 91 are provided with circular heads 93 and 94, respectively, which have a relatively close fit in the spaced holes 82 and 83 provided in the body portions 81 of brackets 75.

To mount the rack 25 on the brackets 75, the heads 93 and 94 of the respective pins 92 and 91 on each of the strip members 56 are inserted into the two spaced holes 82 and 83 on each of the brackets 75 and the rack is initially moved downwardly to position the heads 93 and 94 behind the portions of the longitudinal slots 85 extending below the circular holes 82 and 83 to hold the rack 25 in its concealed position below the panel 20 when the latter is placed over the opening of the well 22. When the panel 20 is moved to its upright position, as illustrated in FIG. 8, the moving of the rack 25 toward its elevated position on the panel 20 causes the pins 91 and 92 to move upwardly along the paths of the longitudinal slots 85 on the respective brackets 75. Upon the upper pins 91 contacting the upper ends of the longitudinal slots 85, the rack 25 is moved sidewise such that the pins 91 and 92 move into the transverse slots 87 and 89, respectively, and then the rack is moved downwardly such that the pins 91 and 92 seat in the short downwardly extending terminating slots 86 and 88, respectively, thereby latching the rack in its elevated position.

While the invention has been illustrated and described in detail in the drawings and foregoing description, the same is considered to be illustrative and not restrictive in character, it being understood that only the preferred embodiments have been shown and described herein and that all changes and modifications that come within the spirit and scope of the invention are also desired to be protected.

What is claimed is:

1. A combination of a plastic bag rack and an adjustable mount for mounting said rack on the undersurface of a panel movable between a position in which it covers a well provided in the table top of a checkstand at a supermarket and an upright position on the rear of said well, said combination comprising:

a rack having a pair of side support arms, each said side support arm including a front and rear shoulder;

a downwardly and rearwardly extending bottom side member joined to the end of each of the front shoulders;

an upper transverse member for joining the ends of the rear shoulders;

a lower transverse member for joining the ends of the downwardly and rearwardly extending bottom side members;

a pair of strip members connected across the upper and lower transverse members;

a pair of attachment means connected on the undersurface of said panel, each said attachment means having a longitudinal slot on a front wall thereof; and a pair of pins slideably extending through the longitudinal slot on the front wall of each said attachment means;

said pair of pins having one of the ends thereof engaged to said strip member and having heads on the opposite ends thereof retained within the longitudinal slot on the front wall of said attachment means to thereby provide for coupling said strip member to the front wall of said attachment means;

whereby when said panel is disposed in an upright position said rack can be held on said attachment means in a first location in which all portions of the rack are below the upper edge of said panel and a second location in which a portion of the rack is elevated above the upper edge of said panel.

2. A combination of a plastic bag rack and an adjustable mount as defined in claim 1 wherein said panel is hingedly connected to a retaining rear member residing in a vertical guideway provided on the rear of said well;

wherein when said panel covers said well said rack is held below the bottom surface thereof in said first location; and wherein when said panel is disposed in an upright position in said vertical guideway on the rear of said well, said rack is held to be cantilevered from the back surface thereof in said second location.

3. A combination of a plastic bag rack and an adjustable mount as defined in claim 1 wherein each said attachment means comprises:

a bracket formed of a single strip of metal to include a flat body portion with end legs for connecting said bracket in a spaced relation relative to the surface of said panel;

a pair of spaced holes in the lower portion of said flat body portion;

said longitudinal slot extending from below the lowest hole to the upper end portion of said flat body portion;

a pair of transverse slots, the upper one thereof joined to the upper end of said longitudinal slot and the lower one thereof joined to the longitudinal slot at a distance from the upper one equal to the spacing of said pair of holes on said flat body portion; and short terminating slots at the outer ends of said transverse slots extending parallel to said longitudinal slot.

4. A combination of a plastic bag rack and an adjustable mount for mounting said rack on the undersurface of a panel movable between a position in which it is in an upright position on the rear of a well provided in the table top of a checkstand at a supermarket and a position in which it covers the well, said combination comprising:

a rack having a pair of side support arms, each said side support arms including a front and rear shoulder;

a downwardly and rearwardly extending bottom side member joined to the end of the front shoulders;

an upper transverse member for connecting the ends of the rear shoulders;

a lower transverse member for connecting the ends of the downwardly and rearwardly extending bottom side members;

a pair of strip members connected across the upper and lower transverse members;

a pair of support channel members, each having a longitudinal slot on the front wall thereof;

a plate member slideably moveable within each said support channel member; and a pair of upper and lower pins slideably extending through holes in each of said plate members and through the longitudinal slot on the front wall of each said support channel members;

each pin of said pair of pins having the outer end thereof engaged to said strip member and having a head on the inner end thereof retained by the plate member within said support channel member to thereby provide for coupling said strip member to said support channel member.

5. A combination of a plastic bag rack and an adjustable mount as defined in claim 4 wherein said outer end of said lower pin passes loosely through a hole in said strip member and is retained thereon by an enlarged end means and said outer end of said upper pin is anchored to said strip member.

6. A combination of a plastic bag rack and an adjustable mount as defined in claim 4 wherein said panel has a spacer member connected to each side of the undersurface thereof, and wherein one of said support channel members is anchored on each said spacer member.

7. A combination of a plastic bag rack and an adjustable mount as defined in claim 4 wherein said upper transverse member has a hook welded thereon.

8. A combination of a plastic bag rack and an adjustable mount as defined in claim 4 wherein each said support channel member has upper and lower limiting buttons on the back inner surface thereof, and wherein said sliding plate member has a bent end which contacts said limiting buttons as it slides between the ends of said support channel member.

9. A combination of a plastic bag rack and an adjustable mount as defined in claim 4 wherein each said support channel member has a slot on the back upper end thereof in which said upper pin can reside to enable the head on the inner end thereof to hold the rack in an elevated location on said panel when the latter is in an upright position.

10. A combination of a plastic bag rack and an adjustable mount for mounting said rack on the undersurface of a panel moveable between a position in which it covers a well provided on the table top of a checkstand at a supermarket and an upright position in a vertical guideway on the rear of said well, said panel being hingedly connected to a retaining rear member residing in the vertical guideway, said combination comprising:

a rack having a pair of side support arms and a back;

a pair of strip members connected on the back of said rack;

a pair of elongated attachment means on the undersurface of said panel; and means adjustably coupling each of said strip members to a respective one of said attachment means so as to be slideably movable along the length thereof;

whereby when said panel is in an upright position in said vertical guideway, said rack can be held by its strip members on said attachment means in a first position in which all portions of the rack are located below the upper edge of said panel and in a second position in which a portion of the rack is located above the upper edge of said panel.

* * * * *